United States Patent [19]

Kohl

[11] 4,196,600

[45] Apr. 8, 1980

[54] SLIDER NEEDLES FOR WARP KNITTING MACHINES

[75] Inventor: Karl Kohl, Obertshausen, Fed. Rep. of Germany

[73] Assignee: Karl Mayer Textilmaschinenfabrik GmbH, Obertshausen, Fed. Rep. of Germany

[21] Appl. No.: 924,246

[22] Filed: Jul. 13, 1978

[30] Foreign Application Priority Data

Jul. 13, 1977 [DE] Fed. Rep. of Germany ..... 2731634

[51] Int. Cl.[2] ..... D04B 35/04

[52] U.S. Cl. ..... 66/120

[58] Field of Search ..... 66/116, 120, 123

[56] References Cited

U.S. PATENT DOCUMENTS

| | | | |
|---|---|---|---|
| 189,501 | 4/1877 | Salisbury | 66/120 |
| 1,673,634 | 6/1928 | Page | 66/120 X |
| 1,866,222 | 7/1932 | Pledger | 66/120 |
| 3,584,481 | 6/1971 | Hayashi | 66/120 |

FOREIGN PATENT DOCUMENTS

| | | | |
|---|---|---|---|
| 47-7746 | of 1972 | Japan | 66/120 |

*Primary Examiner*—Ronald Feldbaum
*Attorney, Agent, or Firm*—Omri M. Behr

[57] ABSTRACT

Slider needles for use with warp knitting machines which may be used to provide a trick plate thread layed in around the needles includes a hook formed end portion and a shank portion with a groove provided therein. A slider member slidably cooperates with the groove and is coupled to the machine driving means. The slider member has one end portion extending from the shank to the tip of the needle hook end portion. The slider member is further provided with an enlarged cam portion displaced from the tip thereof, which is disposed within the mouth of the hook opening when the hook is closed in a first position and recedes towards the shank, opening the hook, in a second position.

8 Claims, 4 Drawing Figures

SLIDER NEEDLES FOR WARP KNITTING MACHINES

BACKGROUND OF THE INVENTION

The present invention relates to slider needles for warp knitting machines, and in particular, relates to a slider needle having a slider provided with a cam to perform the function of a conventional trick plate.

In the prior art, warp knitting machines conventionally utilized a trick plate and associated guides to lay in a trick plate thread. These guides are affixed to a guide bar and move up and down simulating trick plate action. Typical of these is German patent OLS No. 1,585,511. As the thread guide pass between the needles, the slider of the needle is fully opened permitting the thread to enter the opening of the needle. The guides must swing alongside the needle, approximately at the level of the hook portion, in order to lay the appropriate thread into the hook opening. They are moved out of the hook opening by the downward movement of the thread guides so that the thread slides on to the needle shaft. The threads as they are moved out of the needle openings should become positioned under the cam on the slider, which is positioned near the tip thereof, so that the slider is in a position to move the thread in a downwardly direction as the slider moves in that direction. The position of this cam at the very top of the slider makes it more difficult to form the ground stitch, since the trick plate thread may remain stuck within the hook opening. Also, it is necessary to provide a further suspension means with steering to accomplish the trick plate-like movement of the thread guides.

Another machine, known in the prior art, wherein the guides perform a trick plate-like movement is Japanese Utility Model No. 39-19271. However, the disclosure in this patent uses compound or tubular needles which are not readily adaptable to include a cam mechanism.

The present invention overcomes the shortcomings found in the prior art by utilizing a different location for the cam and/or modification of the needle shank. In the preferred embodiment of the present invention, when the guides carrying the trick plate threads swing through the spaces between the needles in the forward direction, the hook openings of the needles are partially or entirely closed by the slider mechanism.

The cam on the slider is positioned below the top of the slider proximate the area where the slider leaves the shank of the needle. Using this configuration, only one suspension system is required for all the guides, since the hook openings of the needles are protected against the entry thereinto of the trick plate threads. Therefore, the guides of the trick plate threads can, like the other ground thread guides, swing through at the same height as the needle hook opening without requiring an additional movement. Furthermore, the formation of the regular stitches can continue as before, since the height of the closure of the slider remains as usual.

In a warp knitting machine, according to the principles of the present invention, there are provided at least two guide bars, a needle bar having a plurality of slider needles thereon, and cooperating driving means, one of the guide bars is provided with a plurality of guides for laying in ground threads and the other guide bar is provided with a plurality of guides for laying in trick plate threads. In the present machine each slider needle comprises a hook formed end portion and a shank portion having a slot provided therein. A slider member is disposed in the slot and slidably cooperates therewith. Each slider has one end portion thereof extending from the shank portion across the mouth of the opening of the hook portion acting to close the mouth in a first position and acting to open the mouth in a second position. The slider member end portion has a narrow tip portion adapted to cooperate with the tip of the hook formed end and an enlarged cam portion displaced away from the tip portion and disposed within the mouth of the opening in the first position. The other end portion of the slider member is adapted to be coupled to the driving means for movement from said first to said second position.

BRIEF DESCRIPTION OF THE DRAWING

In order that the invention may be more fully understood, it will now be described, by way of example, with reference to the accompanying drawing in which.

DESCRIPTION OF THE PREFERRED EMBODIMENTS

Figure 1:
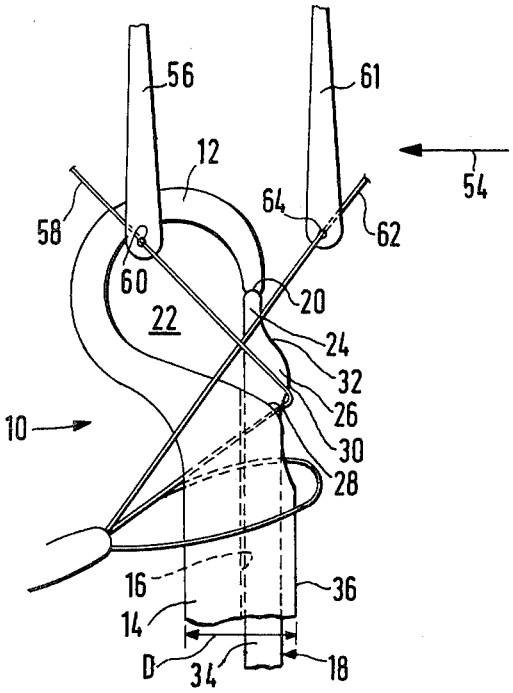
FIG. 1 is an enlarged pictorial representation of a needle, according to the principles of the present invention, with the slider closing the needle opening.
Figure 2:
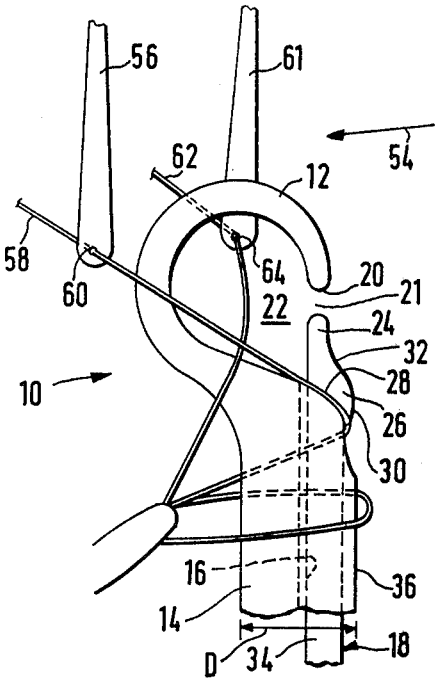
FIG. 2 is a pictorial representation of the needle shown in FIG. 1 with the slider moved downwardly, opening the needle.

Referring now to the figures, and in particular, to FIGS. 1 and 2, there is shown a slider needle 10 which includes a hook formed end portion 12 and a shank portion 14. The shank portion 14 is provided with a groove or slot 16 into which a slider member 18 is slidably mounted for up and down movement as shown in the figures. The slider member 18 is shown in its uppermost position in FIG. 1 where it comes in contact with the tip 20 of the end portion 12. Preferably, the mouth 21 of the opening 22 of the needle 10 is closed completely when the slider member 18 is in the uppermost position, although this is not necessarily required for proper operation.

The slider member 18 is provided with a narrow tip portion 24 and, remote therefrom, is provided with a cam portion 26. With the slider in its uppermost position the cam 26 extends outwardly from the edge 28 of the shank 14 in an upwardly direction closing the mouth 21 of the opening 22. The slope of the cam surface 30, facing the shank portion 14, is much steeper than the slope 32 which faces the tip 20 of end 12. The slope 30 may be relatively flat and of constant value directed towards tip 24. The other end 34 of the slider member 18 is adapted to be coupled to the source of driving power for the warp knitting machine, not shown.

In the embodiment shown in FIG. 1, the enlarged cam portion 26 at its thickest point does not extend beyond the end surface 36 of the shank portion 14. Or, stating it another way, the cam portion 26 is within the diameter D of the shank portion 14 of the needle 10.

Figure 3:
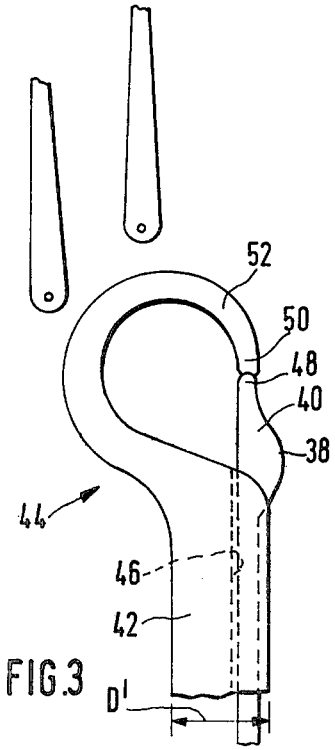
FIG. 3 is an alternate embodiment of the present invention illustrating the cam extending beyond the diameter of the shank.

In the embodiment shown in FIG. 3, the cam portion 38 of the slider member 40 extends beyond the diameter D' of the shank portion 42 of the slider needle 44. The shank portion 42 of the needle 44 is provided with a groove or slot 46 in the same manner provided in the embodiment shown in FIGS. 1 and 2. The slider member 40 is also provided with a narrow tip portion 48 which cooperates with the tip portion 50 of the hook formed end portion 52 of slider needle 44. The embodiment shown in FIG. 3 functions in the same manner as the embodiment shown in FIGS. 1 and 2.

In operation, the thread guides 56 and 61 are coupled to the driving means, not shown, and move in the direction of arrow 54, which is in the forward direction relative to the warp knitting machine. When the guide 56, carrying the trick plate thread 58 in an aperture 60 provided in the end of guide 56, passes around the needle 10, thread 58 cannot enter the opening 22 because the slide member 18 is in its uppermost position. The trick plate thread does not enter the opening 22 but instead runs over the cam portion 26 and is engaged thereby.

When the slider member 18 is moved in a downwardly direction, thread 58 is moved in a downwardly direction also, as the ground thread guide bar 61 moves in a forwardly direction (in the direction of arrow 54), carrying ground thread 62 in aperture 64 provided in its end thereof. Since the slider member 18 has moved in a downwardly direction, an entrance path into the opening 22 has been provided for the thread 62, allowing it to readily enter the opening. Thus, when the needle is lowered to remove the stitch therefrom, the thread 58 is captured by the ground thread 62 and does not form a stitch by itself, thereby reducing the amount of trick plate thread used.

Figure 4:
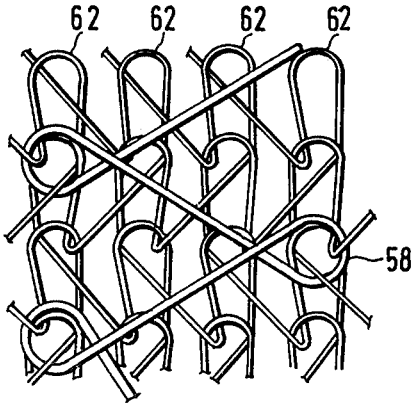
FIG. 4 illustrates the stitch structure made with the inventive needle.

The formation of the stitch with the trick plate thread laid therein is shown more clearly in FIG. 4.

Although the present invention has been described with respect to a single needle and a pair of guide members, it is to be clearly understood that a plurality of slider needles and guide members affixed to the appropriate guide bars of a conventional warp knitting machine may be utilized.

Hereinbefore has been disclosed a slider needle for use in warp knitting machines, which may be utilized without the use of a conventional trick plate. It will be understood that various changes in the details, materials, arrangement of parts and operating conditions which have been herein described and illustrated in order to explain the nature of the invention may be made by those skilled in the art within the principles and the scope of the present invention.

Having thus set forth the nature of the invention what is claimed is:

1. In a warp knitting machine having at least two guide bars, a needle bar having a plurality of slider needles thereon, and cooperating driving means, one of said guide bars being provided with a plurality of guides for laying in ground threads and the other guide bar being provided with a plurality of guides for laying trick plate threads, the improvement wherein each said slider needle comprises:

(a) a hook formed end portion and a shank portion, said shank portion having a slot provided therein; and (b) a slider member disposed in said slot and slidably cooperating therewith, said slider member being driven by said driving means and;

(i) having one end portion thereof extending from said shank portion across the mouth of said hook end portion acting to close said mouth in a first position and acting to open said mouth in a second position, said one end portion having a narrow tip portion adapted to cooperate with the tip of said hook formed end portion, and (ii) including an enlarged cam portion displaced away from said tip portion and disposed within said mouth in said first position, the other end portion of said slider member being adapted to be coupled to said driving means for movement from said first to said second position.

2. A slider needle according to claim 1, wherein said slider member cam portion is disposed proximate said needle shank portion when said slider is in said first position.

3. A slider needle according to claim 1, wherein said slider member cam portion is within the diameter of said needle shank portion.

4. A slider needle according to claim 1, wherein said slider member cam portion extends beyond the diameter of said needle shank portion.

5. A slider needle according to claim 1, wherein the slope of the cam surface facing towards the needle shank portion is steeper than the slope of the cam surface facing towards the needle hook portion.

6. A slider needle according to claim 1, wherein the slope of the cam surface facing towards the needle hook portion is relatively constant.

7. A slider needle according to claim 1, wherein said shank is provided with means for removing the weft thread from said slider cam.

8. A slider needle according to claim 7, wherein said shank removing means is a sloped edge.

* * * * *